US006583395B2

(12) United States Patent
Furtlehner et al.

(10) Patent No.: US 6,583,395 B2
(45) Date of Patent: Jun. 24, 2003

(54) FOCUSING MICROWAVE APPLICATOR

(75) Inventors: Jean-Pierre Furtlehner, Jouy-en-Josas (FR); Alexandre Hugla, Paris (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 10/070,640

(22) PCT Filed: Jul. 20, 2001

(86) PCT No.: PCT/FR01/02378

§ 371 (c)(1),
(2), (4) Date: Mar. 11, 2002

(87) PCT Pub. No.: WO02/09477

PCT Pub. Date: Jan. 31, 2002

(65) Prior Publication Data

US 2002/0134779 A1 Sep. 26, 2002

(30) Foreign Application Priority Data

Jul. 21, 2000 (FR) ..... 00 09607

(51) Int. Cl.[7] ..... H05B 6/70

(52) U.S. Cl. ..... 219/695; 219/690; 219/746; 219/750; 333/248

(58) Field of Search ..... 219/690–697, 219/745–750; 333/248, 251, 253; 422/186.05, 186.04

(56) References Cited

U.S. PATENT DOCUMENTS

| | | | | | |
|---|---|---|---|---|---|
| 4,839,494 | A | * | 6/1989 | Vulpe | 219/695 |
| 5,449,889 | A | * | 9/1995 | Samardzija | 219/695 |
| 5,635,143 | A | | 6/1997 | White et al. | |
| 6,265,702 | B1 | * | 7/2001 | Drozd et al. | 219/745 |

FOREIGN PATENT DOCUMENTS

| | | |
|---|---|---|
| EP | 0967841 | 12/1999 |
| FR | 2759239 | 8/1998 |
| JP | 54016745 | 2/1979 |

* cited by examiner

*Primary Examiner*—Philip H. Leung
(74) *Attorney, Agent, or Firm*—Thelen Reid & Priest LLP; Robert E. Krebs

(57) ABSTRACT

The microwave applicator for microwaves outputs from a guide (1) comprises an envelope (3) that forces microwaves to converge towards a focal point (16) by means of a complementary central reflector (4). A fraction of the waves reaches this point after reflection on two facets (11, 13), usually curved and concave, of the reflector (4) and the envelope (3), while the other fraction is reflected three times on three facets (10, 12 and 14), the last two facets of which form part of the envelope and one of which is concave for focussing. These devices can be used for removing a concrete surface, because the microwaves cause vaporisation at the focal point (16).

21 Claims, 4 Drawing Sheets

FOCUSING MICROWAVE APPLICATOR

"This application is a national phase of PCT/FR01/02378 which was filed on Jul. 20, 2001, and was not published in English."

The subject of this invention is a microwave applicator that has the specific function of making a microwave beam output from a wave guide converge approximately at a point. One essential application of these appliances is superficial scarification of concrete in order to remove a crust that could be contaminated; the microwaves converge under this crust and generate sufficient local heating to evaporate the water contained in the concrete and apply a pressure that makes the crust crumble. The applicator can then be moved along parallel lines to produce striations on the concrete surface. French patent 2 759 239 proposed a solution to obtain this convergence of microwaves starting from an unfocussed divergent beam at the exit from a wave guide; the applicator comprised an envelope with an ellipsoid shaped internal surface reflecting the microwaves, the microwave guide ends at the bottom of the envelope, and the envelope comprised an opening at the opposite end of this bottom part facing the concrete surface, and a central reflector placed in the envelope around the first focal point of the ellipsoid and with a face reflecting microwaves and directed towards the bottom of the envelope. This arrangement was derived from the concept of using the geometric properties of an ellipse and particularly that a wave reflected firstly through one focal point and then by the contour of an ellipse necessarily reaches the second focal point. Thus, the reflecting envelope was in the shape of a portion of an ellipse and the central reflector was located at the first focal point of this ellipse and had an approximately circular shape to reproduce reflection at a point as accurately as possible. Radiation reflected firstly by the central reflector and then by the envelope left the envelope and actually converged at the second focal point of the ellipse under the concrete crust. It was intended to focus at a point with an ellipsoid shaped envelope and a spherical reflector, or on a line—which was preferable in practice in order to scarify the concrete in wide strips—if the envelope was formed of elliptical sections similar to each other and if the central reflector was cylindrical.

However, this applicator was not sufficient since the central portion of the microwave beam emitted parallel to the wave guide was reflected on part of the central reflector that was normal to it, so that it was returned to the microwave guide and did not reach its destination. The purpose of the invention is to overcome this disadvantage and to make all microwaves participate in increasing the temperature of the convergence focal point.

According to the invention, the applicator comprises an envelope with a reflecting inside surface with a bottom and opening opposite each other, the microwave guide opening up in the bottom of the envelope, and a central reflector located in the envelope and comprising one face facing the microwave guide and profiled such that the microwaves are reflected by the inner face of the reflector and then by the inner face of the envelope converging approximately towards a focal point located in front of the opening of the envelope, characterised in that the said face of the central reflector comprises a first central facet and a second side facet on each side of the microwave guide, and the inner face of the envelope comprises a first central facet, a second facet and then a third facet on each side of the microwave guide, the facets being modelled such that a first portion of the microwaves reaches the focal point after being reflected by the second facet of the central reflector and then the second facet of the envelope, and a second portion of the microwaves reaches the focal point after having been reflected by the first facet of the central reflector, the first facet of the envelope and then the third facet of the envelope.

The most innovative element of the invention is therefore that the central portion of the radiation is reflected three times on the envelope before reaching the focal point.

Some particular shapes of facets may be proposed; thus, the second facet of the central reflector may be curved and convex and the second facet of the envelope may be elliptical; or the first facet of the central reflector may be plane, the first facet of the envelope may be circular and concave, and the third facet of the envelope may be plane.

Other features, aspects and advantages of the invention will now be described with reference to the following figures.

Figure 1:
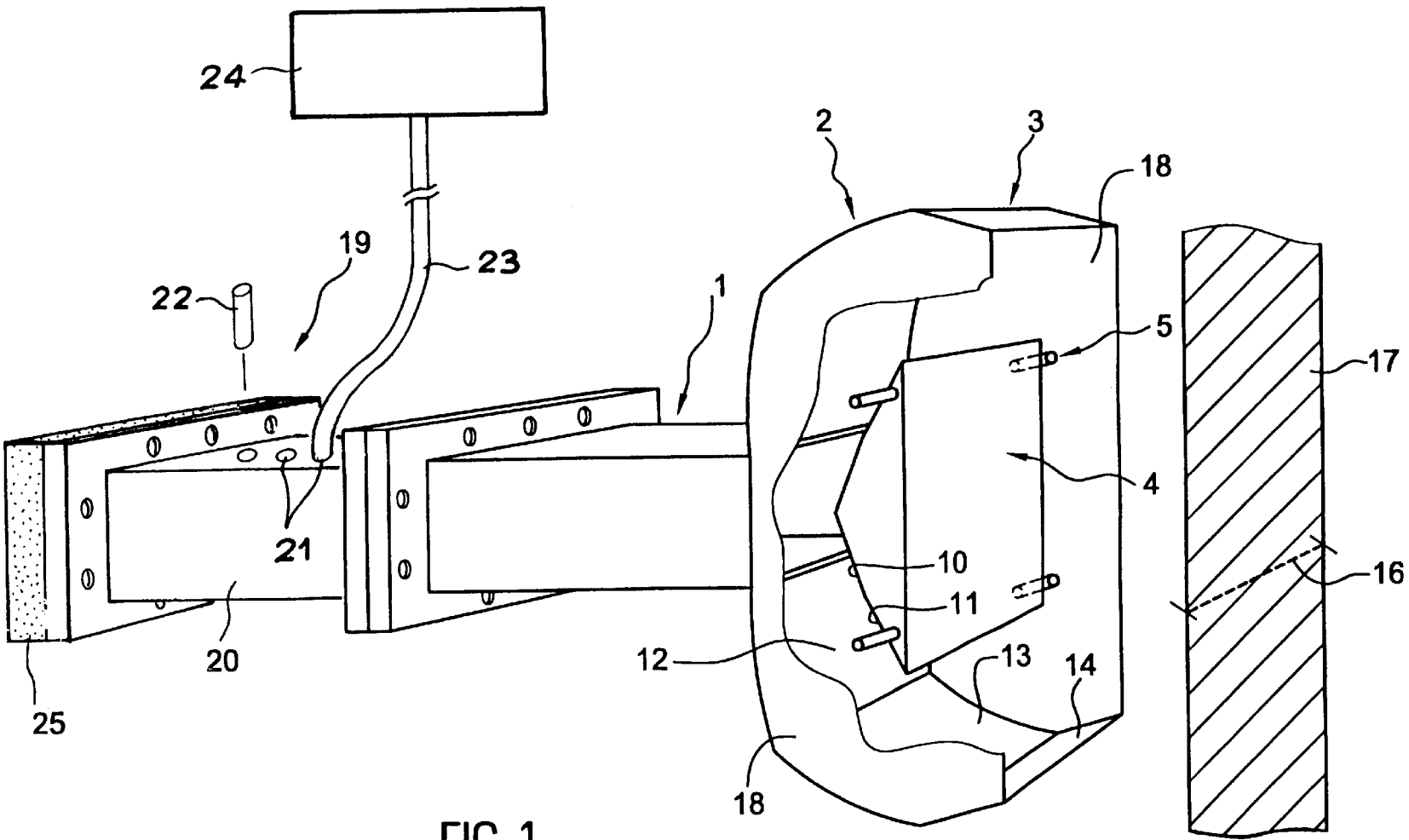
FIG. 1 is a view of the applicator.
Figure 2:
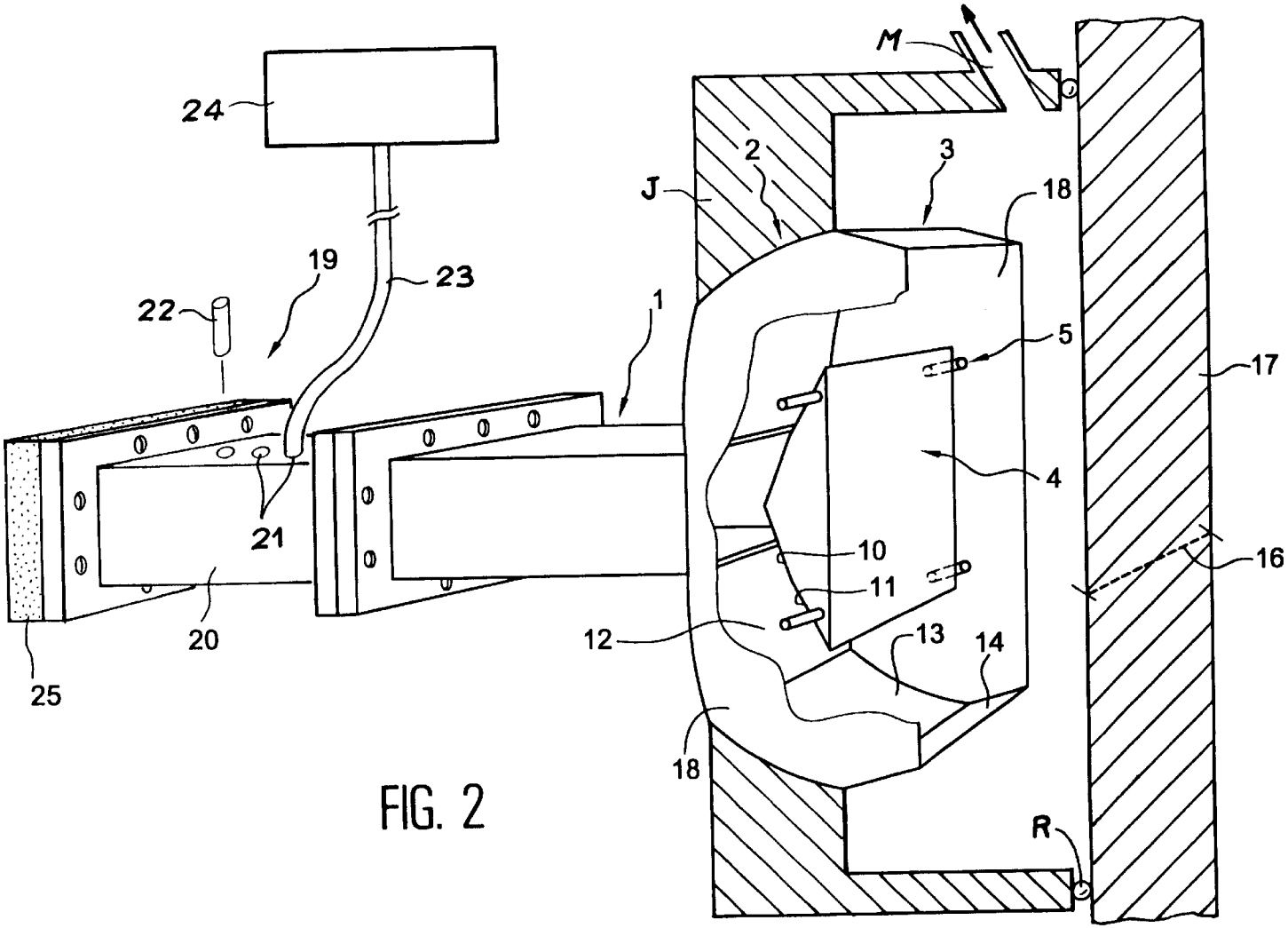
FIG. 2 is a view of an improved version of the applicator.
Figure 3:
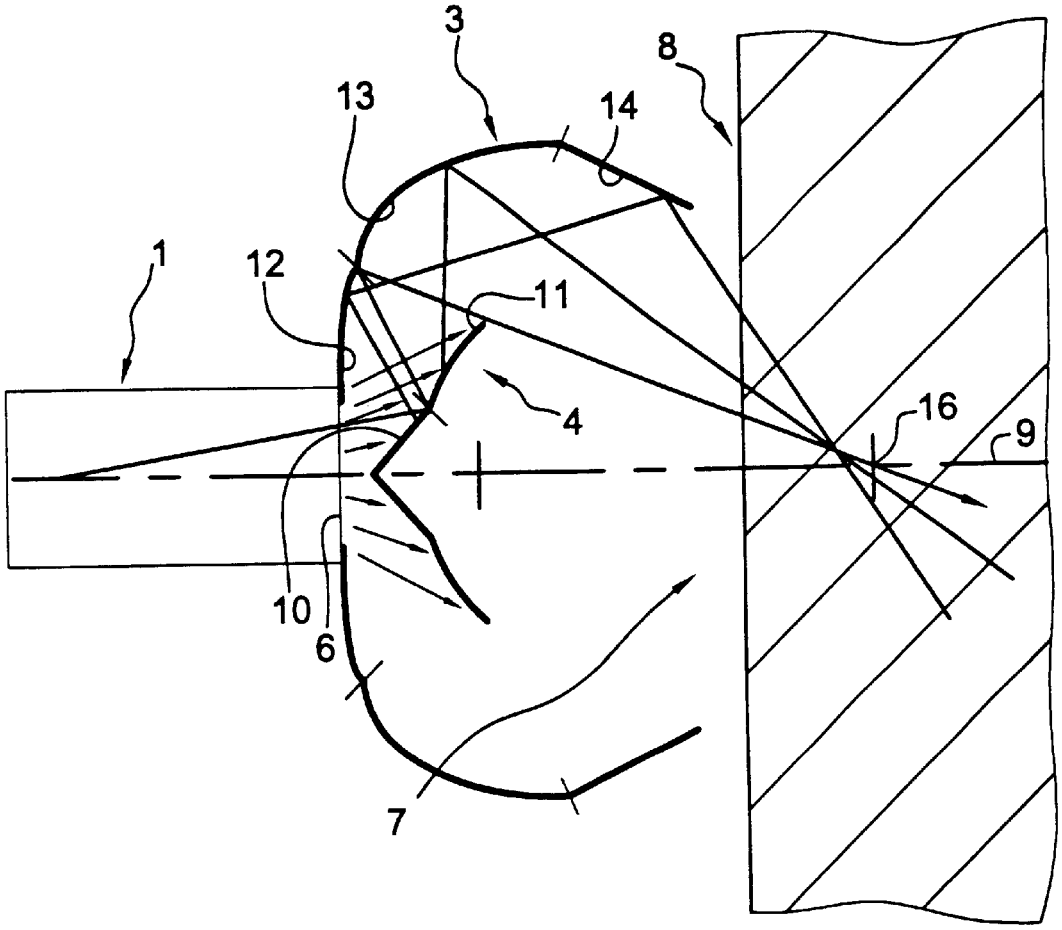
FIG. 3 is a view of the profile of the said applicator.
Figure 4:
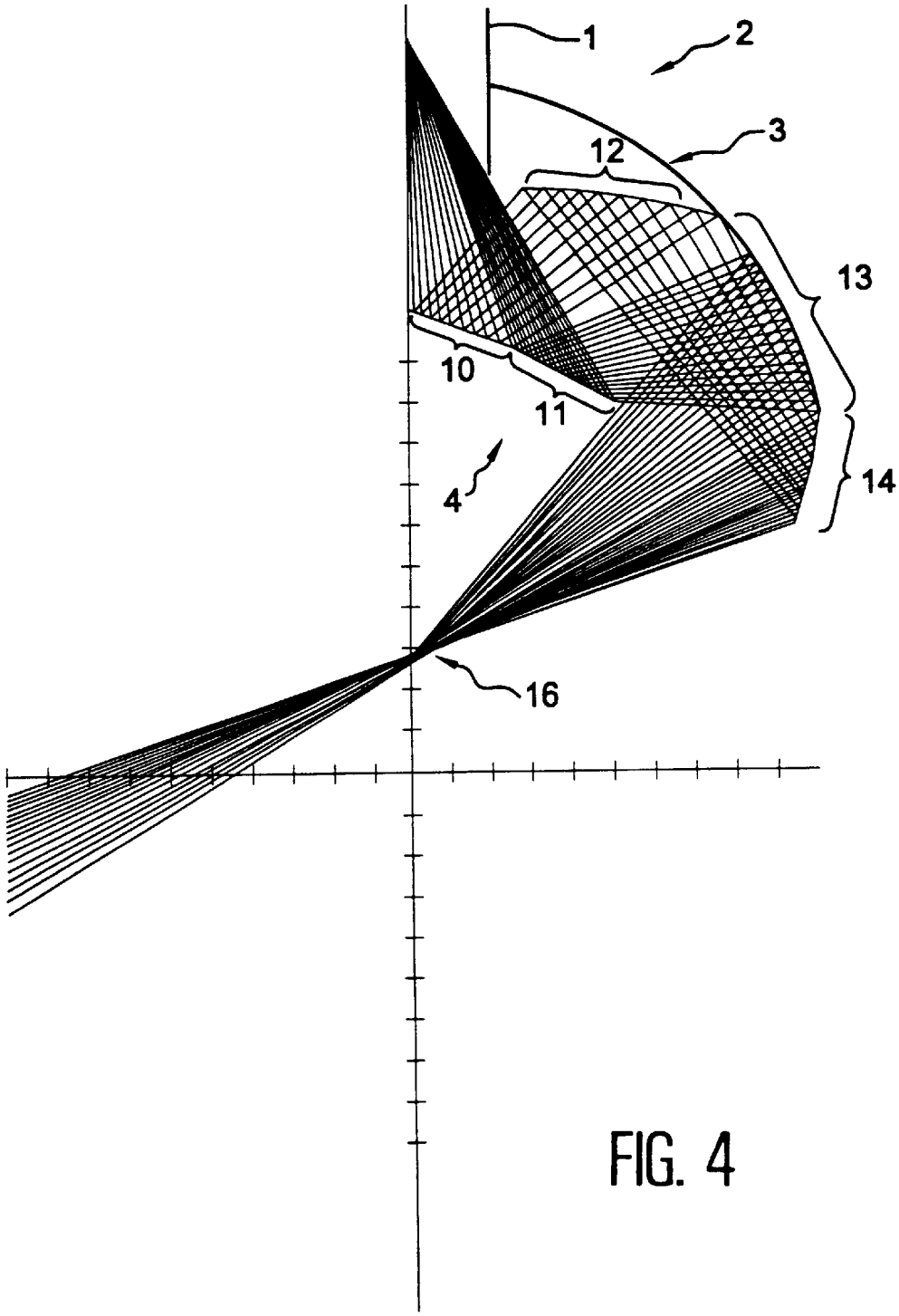
FIG. 4 is a complete diagram of the microwave reflection.

With reference to FIGS. 1, 2 and 3, it can be seen that the applicator comprises a microwave guide 1 and an opening 2 composed of an envelope 3 and a central reflector 4 held in place to the envelope 3 by fasteners 5. The microwave guide 1 opens up inside an opening 6 formed in the bottom of the envelope 2 which also includes a much wider main opening 7 at its opposite end. This main opening 7 is usually placed in front of a material 8 such as a concrete surface that is to be heated. The microwaves output from guide 1 can leave the guide 1 and be dispersed at a fairly wide angle of up to 30° on each side of the plane of symmetry 9 of the applicator.

The inner face of the envelope 3, and a face facing the microwave guide of the central reflector 4, reflect the microwaves again. The second face comprises two facets on each side of the plane 9; a first central and oblique facet 10 touches plane 9, and a second side facet 11 that is also oblique and goes as far as the edge of the central reflector 4. The inner face of the envelope 3 comprises three facets; a first facet 12 adjacent to the microwave guide 1, a second facet 13 prolonging the first facet, and a third facet 14 prolonging the previous facet and going as far as the edge of the main opening 7. Radiation close to plane 9 reaching the first facet 10 of the central reflector 4 is firstly reflected to the first facet 12 of the envelope 3, then to the third facet 14 before reaching a convergence point 16 in front of the opening 2. The most inclined radiation reaching the second facet 11 of the central reflector 4 reaches point 16 after a single reflection with the second facet 13 of the envelope 3.

This second facet 13 of the envelope 3 may remain elliptical, which is a characteristic of the known applicator; the second facet 11 of the central reflector 4 may have various shapes, but it has been observed that plane facets were often insufficient because they need to be fairly wide to intercept all radiation from guide 1, but without intercepting the portion of radiation already reflected passing through the space between facets 12 and 14 of envelope 3. This is why a curved convex shape, always more inclined towards point 16 as the distance from the edge of reflector 4 reduces, is recommended.

On the other hand, the first facet 10 of the central reflector 4 may perfectly well be plane, and the facet 14 of the envelope 3 on which the corresponding portion of the radiation is reflected, may also be plane. In this case it is decided to make the third facet 14 plane, while the first facet 12 of the envelope 3 is concave, curved along an arc of a circle, to make the radiation convergent. For this reason, the concaveness of the facet 13 of the envelope 3 must be greater than the convexity of the second facet 11 of the central reflector 4.

It is emphasised that the envelope 3 and the central reflector 4 are symmetrical about the plane 9. The facets 12, 13 and 14 of the envelope 3 may but are not necessarily adjacent. The simulations made have shown that almost all radiation actually arrives close to the convergent point 16. FIG. 3 shows a complete example of focussing of the radiation.

FIG. 1 illustrates some other aspects of the invention. In particular, it can be seen that the opening 2 extends at a constant cross-section in the direction of the depth, although the focussing point 16 will actually be a line which, when moved in a perpendicular direction produced by a movement of the applicator, will sweep along a strip 17 of the concrete 8. The envelope 3 is closed by sides 18, one of which is shown in a tear off view.

The wave guide 1 may comprise an impedance matcher 19 in the form of a segment of a wave guide 20 in which parallel holes 21 are formed to contain inserts or stubs 22 that partially obstruct the opening, and the capacitive or inductive impedance of which compensates the reactive part of the load (in other words, the concrete in which the waves are focussed). Other screens could be suitable.

One advantageous variant is to place a skirt J made of a material with low permittivity and very low losses at the side close to the main opening 7, and fixed to the applicator around the opening 7 in order to delimit the face in which cleaning waste is collected, between the applicator and the object on which the microwaves are focussed.

One improvement to this skirt consists of providing a lateral suction orifice M through which waste and any water vapour can pass, using suction means not shown since an expert in the subject will be familiar with them.

Another advantageous variant that can be combined with the other variants consists of connecting one or several holes 21 to a pipe 23 from a gas source 24, the purpose of which is to create a positive pressure in the opening 2 in order to flush concrete debris and dust that could have been collected there by forcing a flow towards the opening 7. It is also advantageous if the central reflector 4 entirely covers the orifice of the wave guide 1 to help in protecting it from projections.

Another improvement that can be combined with the others is to use a plug 25 transparent to the microwaves but that obstructs the wave guide 1 to prevent intrusion of concrete debris. It may be made of Teflon or any other dielectric material (quartz, mica, etc.).

FIG. 2 shows the applicator provided with a skirt J made of a low permittivity material with very low losses fixed on the applicator around the opening 7 and fitted with a lateral suction orifice M. The cleaning waste retained by the skirt (J) can then be eliminated through suction means that are not shown because they are well known.

According to another improvement, also shown in FIG. 2, the applicator provided with a skirt fitted with the suction orifice M, is also provided with anti-contact means designed to keep the distance H between the applicator and the object on which the microwaves are focussed approximately constant, despite the suction.

The anti-contact means may for example consist of rollers or balls installed on the skirt J.

The injected gas is usually air passing through pipe 23 and one or several holes 21, and may be combined with the suction through the side suction orifice(s) M. These two functions, initially intended for cleaning waste, also have a favourable effect on operation of the invention. By contributing to cooling the concrete surface, they increase the temperature gradient and thus facilitate spalling of the material. More generally, adding means of cooling the surface to be cleaned is a significant improvement to the invention according to any one of claims 1 to 11. In our preferred embodiment, this cooling is achieved by the joint use of blowing and suction.

Finally, it must be noted that concrete absorbs heat better if reflections at its surface are limited. The Brewster angle, for which the reflection of microwaves is non-existent, is equal to approximately 68° in the case of concrete (taken between the direction of incidence of the waves and the normal to the concrete surface). Therefore, it is useful if a large part of the radiation is close to these conditions. Since the corresponding incidence is fairly flat, the facets 12, 13 and 14 of the envelope 3 are modelled with successive direction changes such that the envelope 3 is narrower at the opening 7 than with the elliptical profiles according to the earlier patent.

The invention is also applicable in all cases (industrial or medical) in which an attempt is made to focus microwaves within an area with small dimensions located at a small distance in front of an applicator. In this respect, note that according to the usually used denomination, microwaves correspond to the frequency band between 300 MHz and 300 GHz. Therefore, this frequency can be varied within the above range without departing from the scope of the invention. The dimensions of the applicator can also be modified so that waves penetrate into the new material in which the microwaves are to be focussed depending on the Brewster's angle for this material, without departing from the scope of the invention.

What is claimed is:

1. Microwave applicator placed at the end of a microwave guide (1) comprising an envelope (3) with a reflecting inner face with a bottom and an opening (7) opposite each other, the microwave guide opening into the bottom of the envelope, and a central reflector (4) placed in the envelope and comprising one face directed towards the microwave guide and profiled such that the reflector and then by the inner face of the envelope converging approximately towards a focal point (16) located in front of the opening of the envelope, characterized in that the said face of the central reflector comprises a first central facet (10), a second lateral facet (11) on the sides of the microwave guide, and the inner face of the envelope comprises a first central facet (12), a second facet (13) and then a third facet (14) on each side of the microwave guide, the facets being modeled such that a first portion of the microwaves reaches the focal point after being reflected by the second facet of the second reflector (11) and then the second facet (13) of the envelope, and a second portion of the microwaves reaches the focal point after being reflected by the first facet (10) of the central reflector, the first facet of the envelope (12) and then the third facet (14) of the envelope.

2. Microwave applicator according to claim 1, characterised in that the second facet (11) of the central reflector is curved and the second facet (13) of the envelope is elliptical.

3. Microwave applicator according to claim 2, characterised in that the first facet (10) of the central reflector is plane, the first facet (12) of the envelope is circular and the third facet (14) of the envelope is plane.

4. Microwave applicator according to claim 1, characterised in that the first facet (10) of the central reflector is plane, the first facet (12) of the envelope is circular and the third facet (14) of the envelope is plane.

5. Microwave applicator according to claim 4, characterised in that the microwaves exit from the applicator at incidences close to an incidence with no reflection for a material in which the focal point (16) is located.

6. Microwave applicator according to claim 1, characterised in that the microwaves exit from the applicator at incidences close to an incidence with no reflection for a material in which the focal point (16) is located.

7. Microwave applicator according to claim 6, characterised in that it comprises a skirt (J) made of a low permittivity material and with very low losses, fixed on the applicator around the opening (7) in order to delimit a space between the applicator and the object onto which the microwaves are focussed in which the cleaning waste is retained.

8. Microwave applicator according to claim 7, characterised in that it comprises at least one lateral suction orifice, and suction means designed to evacuate cleaning waste retained by the skirt (J).

9. Microwave applicator according to claim 8, characterised in that it comprises anti-contact means designed to keep the distance (H) between the applicator and the object onto which the microwaves are focussed approximately constant.

10. Microwave applicator according to claim 9, characterised in that the anti-contact means designed to keep the distance (H) between the applicator and the object onto which the microwaves are focussed approximately constant, is composed of rollers (R) made of a material with low permittivity and very low losses fixed on the skirt.

11. Applicator according to claim 10, characterised in that it also comprises means of cooling the surface of the material to be cleaned.

12. Microwave applicator according to claim 6, characterised in that the central reflector (4) covers the openings of the microwave guide.

13. Microwave applicator according to claim 1, characterised in that the central reflector (4) covers the orifice of the microwave guide.

14. Microwave applicator according to claim 13, characterised in that the microwave guide comprises a dielectric plug (25) transparent to the microwaves.

15. Microwave applicator according to claim 1, characterised in that the microwave guide comprises a dielectric plug (25) transparent to the microwaves.

16. Microwave applicator according to claim 15, characterised in that the microwave guide comprises an impedance matcher (19) with removable stubs (22).

17. Microwave applicator according to claim 1, characterised in that the microwave guide comprises an impedance matcher (19) with removable stubs (22).

18. Microwave applicator according to claim 17, characterised in that it comprises a skirt (J) made of a low permittivity material and with very low losses, fixed on the applicator around the opening (7) in order to delimit a space between the applicator and the object onto which the microwaves are focussed in which the cleaning waste is retained.

19. Microwave applicator according to claim 17, characterised in that it comprises a blowing device (23, 24) for blowing into the envelope, with a flow directed towards the opening.

20. Applicator according to claim 1, characterised in that it also comprises means of cooling the surface of the material to be cleaned.

21. Microwave applicator according to claim 1, characterised in that it comprises a blowing device (23, 24) for blowing into the envelope, with a flow directed towards the opening.

* * * * *